US005934165A

United States Patent [19]

Chatham

[11] Patent Number: 5,934,165

[45] Date of Patent: Aug. 10, 1999

[54] ADJUSTABLE PUNCH ASSEMBLY

[75] Inventor: Stephen K. Chatham, Bergen, N.Y.

[73] Assignee: Strippit, Inc., Akron, N.Y.

[21] Appl. No.: 08/820,577

[22] Filed: Mar. 19, 1997

[51] Int. Cl.[6] ..... B26D 7/26; B26F 1/14

[52] U.S. Cl. ..... 83/588; 83/143; 83/552; 83/640; 83/686; 83/698.91; 83/699.41

[58] Field of Search ..... 83/138, 139, 140, 83/698.91, 142, 143, 145, 146, 552, 588, 640, 699.31, 699.41, 699.51, 699.61, 686

[56] References Cited

U.S. PATENT DOCUMENTS

| | | | |
|---|---|---|---|
| 3,114,280 | 12/1963 | Schott | 83/698.91 X |
| 3,211,035 | 10/1965 | Whistler, Sr. et al. | 83/698.91 X |
| 3,548,700 | 12/1970 | Herzog et al. | 83/698.91 |
| 3,779,113 | 12/1973 | Jestin | 83/698.91 X |
| 4,141,264 | 2/1979 | Weisbeck | 83/140 X |
| 4,375,774 | 3/1983 | Wilson et al. | 83/140 |
| 4,658,688 | 4/1987 | Shah et al. | 83/552 |
| 4,688,459 | 8/1987 | Osborn et al. | 83/698.31 |
| 5,048,385 | 9/1991 | Eckert et al. | 83/552 X |
| 5,062,337 | 11/1991 | Johnson et al. | 83/552 |
| 5,613,416 | 3/1997 | Fujita | 83/140 X |
| 5,647,256 | 7/1997 | Schneider | 83/698.91 X |

FOREIGN PATENT DOCUMENTS

| | | | |
|---|---|---|---|
| 907076 | 4/1961 | United Kingdom . | |
| 1 290 893 | 9/1972 | United Kingdom . | |
| 1 315 152 | 4/1973 | United Kingdom | 83/698.91 |
| 1 315 153 | 4/1973 | United Kingdom | 83/698.91 |
| 2 174 329 | 11/1986 | United Kingdom . | |

*Primary Examiner*—Clark F. Dexter
*Attorney, Agent, or Firm*—Simpson, Simpson & Snyder

[57] ABSTRACT

An adjustable punch assembly is provided for use at an indexable punching station in a turret punch press. The overall length of the punch assembly may be adjusted using a motor and pulley system that is also used for indexing the punch tool. Further, the punch assembly includes a quick disconnect connection between the punch driver and the punch tip that facilitates the changing of the punch tip.

8 Claims, 6 Drawing Sheets

FIG. 4
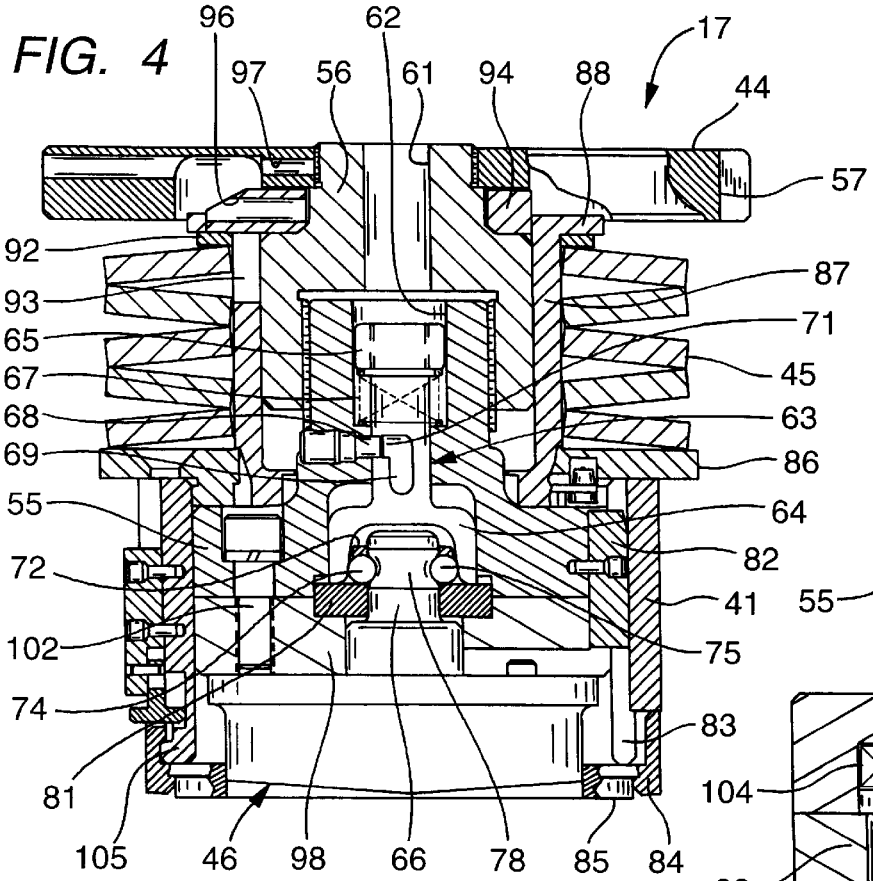
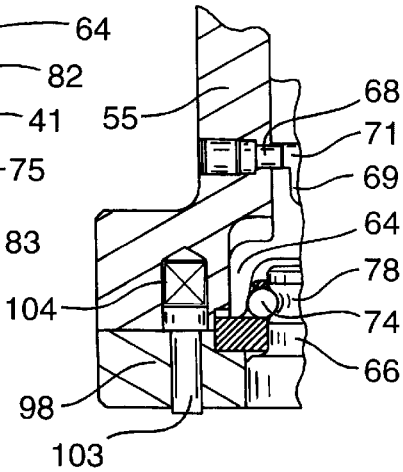
FIG. 4A
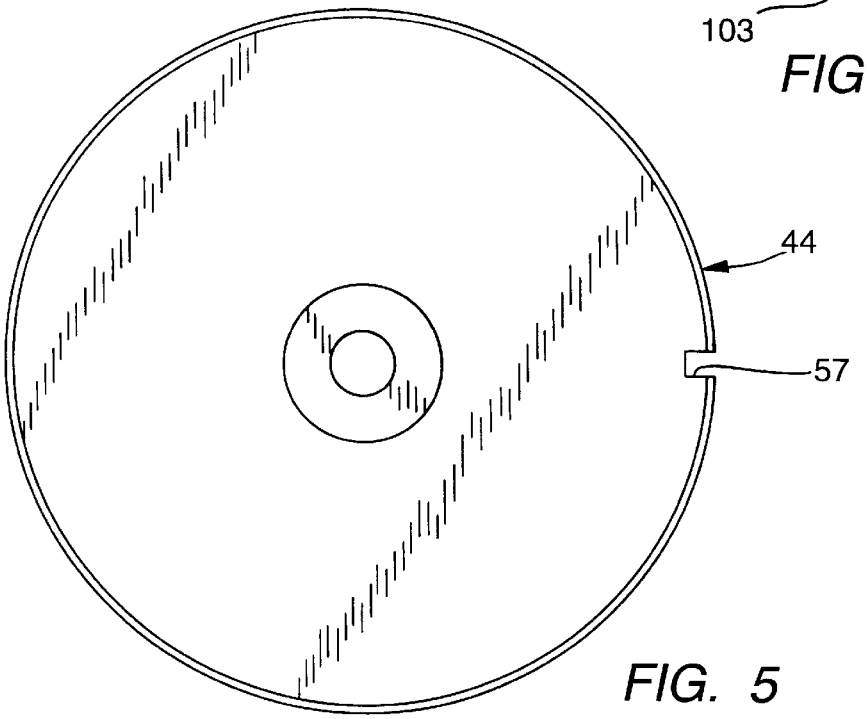
FIG. 5

ADJUSTABLE PUNCH ASSEMBLY

FIELD OF THE INVENTION

The present invention relates generally to punch assemblies such as those usable with indexable multiple station turret punch machines.

BACKGROUND OF THE INVENTION

It is known to provide rotatable and indexable punching tools in a turret punch press where the upper and lower punching tools are rotated synchronously for different orientations of the punch tools. Further, it is known to provide multiple station turret punch machines which provide a large number of different punch stations for use in conjunction with a like number of opposing die surfaces. Each station may include an upper punch assembly and a lower die assembly. The typical configuration of the punch assembly includes a punch tip that is mounted onto the lower end of a punch driver which, in turn, is threadably connected to a punch head.

As illustrated in U.S. Pat. No. 4,375,774, which is incorporated herein by reference, the punch tip can become dull or worn during use. As a result, the tips are routinely sharpened using a grinding operation which shortens the overall length of the punch tip, and accordingly, the overall length of the punch assembly. Because the distance between the cutting edge of the punch tip and the workpiece is a critical dimension, control of the vertical position, and hence the overall length of the punch assembly, is important. U.S. Pat. No. 4,375,774 discloses an adjustable punch assembly whereby the punch driver is threadably attached to the punch head. By rotating the punch driver with respect to the punch head, the overall length of the punch assembly can be shortened or lengthened.

Further, punch presses having indexable tool stations enable the punch assembly, and hence the punch tip, to be rotated so that the punch tip can be applied to the workpiece in different orientations. Punch presses employing indexable punch stations are disclosed in U.S. Pat. Nos. 5,048,385 and 4,658,688, both of which are incorporated herein by reference and both of which are owned by the assignee of the present application.

Specifically, U.S. Pat. No. 4,658,688 discloses a turret punch press having an upper and lower turret tool holder which carries a number of punch and die sets in individual tool holding stations in the turrets. At least one of the corresponding tool holding stations in the upper and lower turrets is indexable to different angular orientations. Rotation of the indexable punch tools is accomplished by a slidably mounted motor for engagement with a timing pulley, which, through a timing belt and harmonic gear drive, acts to rotate the tool holder which carries the punch and die set. In this device, each of the turrets may be equipped with tool stations which receive tool support devices that are rotatable to selectively position the tools at chosen angular positions by rotating the tool sets about their longitudinal axes.

U.S. Pat. No. 5,048,385 discloses a punch assembly for an indexable punching station which includes a striker body having a solid portion and a punch carrier which carries a plurality of individual punches. A selectively actuable stop holds the striker body stationary, allowing the punch holder to be rotated so that one of the plurality of punches will underlie the solid portion of the striker body. The stop may then be deactivated so that the entire punch assembly may be rotated to a variety of angular orientations. Rotation of the assembly thus permits a single punch to be used to punch holes of the same shape but with differing angular orientations.

Thus, U.S. Pat. No. 4,375,774 discloses an adjustable punch assembly whereby the overall length of the punch assembly may be adjusted to accommodate for wear on the punch tip or the shortening of the punch tip due to sharpening or grinding operations. U.S. Pat. Nos. 4,658,688 discloses an indexable tool station which permits the angular rotation of the punching tool. U.S. Pat. No. 5,048,385 expands on this concept by enabling the angular rotation of the entire punch assembly and further angular rotation of a tool holder to thereby selectively dispose a selected punch tool under the solid portion of the striker body.

However, the punch tip disclosed in U.S. Pat. No. 4,658,688 and punch tips generally known in the art are attached to the punch driver by a threaded shaft that passes through axial passageways in both the punch head and the punch driver. The shaft needs to be tightened to a specific torque rating in order to properly retain the punch tip. Thus, changing the punch tip in favor of an alternative punch tip is time consuming and therefore costly. Accordingly, there is a need in the punch press art for punch tips that may be changed more quickly and therefore more economically than currently available punch tips.

Further, while U.S. Pat. No. 4,658,688 discloses a punch assembly having an overall length that may be adjusted by rotating the punch head with respect to the punch driver, the design disclosed in U.S. Pat. No. 4,658,688 requires that any length adjustment be made during the initial installation of the punch tip. There is no way to adjust the overall length of the punch assembly during operation of the punch press. Accordingly, there is a need for an improved punch assembly that may be length adjusted during operation to compensate for tip wear, changes in the workpiece material or other operational variables.

SUMMARY OF THE INVENTION

The present invention satisfies the aforenoted needs by providing an improved punch assembly and an improved punch press.

The punch assembly of the present invention includes a punch driver with an axial passageway extending therethrough. The axial passageway of the punch driver accommodates a locking shaft that is releasably coupled to the punch tip. More specifically, the locking shaft includes a downwardly directed tapered socket for receiving an upper end of a punch tip shaft that extends upward from the punch tip. The upper end of the punch tip shaft includes one or more detents that form one half of a ball/detent connection between the punch tip and the punch driver.

The axial passageway extending through the punch driver includes a lower end that accommodates a cylinder which receives the punch tip shaft. The cylinder includes a plurality of spaced holes, each hole being in alignment with a ball that is trapped between an inside surface of the socket and a cylinder.

To connect the punch tip to the locking shaft that extends through the punch driver, the locking shaft, and specifically the socket, is pushed downward onto the upper end of the punch tip shaft. As a result, an inside surface of the socket pushes the balls through the spaced holes of the cylinder so that the balls engage the detent disposed at the end of the punch tip shaft to provide a ball/detent connection between the punch tip shaft and the locking shaft.

In an embodiment, the locking shaft further comprises an upper end that is spring biased upwards and a middle section disposed between the upper end of the locking shaft and the socket, which is disposed at the lower end of the locking shaft. This middle section comprises a slot having a lower portion and an upper portion. The punch driver further comprises a cooperating key that is accommodated in the slot. As the locking shaft is pushed downward, and the key is disposed in the upper portion of the slot, the balls are pushed inward through the base openings of the cylinder by the inside surface of the socket so that the balls engage the detent of the punch tip shaft to make the ball/detent connection.

In an embodiment, an upper portion of the slot disposed in the middle section of the locking shaft extends horizontally and the lower portion of the slot extends vertically so that in order to lock the socket of the locking shaft onto the upper end of the punch tip shaft, the locking shaft is pushed downward so that the key of the punch driver extends through the vertical portion of the slot and then the locking shaft is twisted thereby causing the key to travel along the horizontal portion of the slot to lock the socket over the upper end of the punch tip shaft.

In an embodiment, the punch assembly further comprises a punch head that is threadably connected to an upper end of the punch driver. The punch head also includes an axial passageway that is in alignment with the axial passageway disposed in the punch driver. As a result, the upper end of the locking shaft is accessible through the axial passageway of the punch head.

In an embodiment, the punch driver is further equipped with a downwardly biased ejector pin that engages an upper surface of the punch tip and that assists in the removal of the punch tip from the punch driver.

In an embodiment, to remove the punch tip from the punch assembly, the locking shaft is rotated until the key of the punch driver is in alignment with the vertical portion of the slot disposed in the middle section of the locking shaft. When the key is in alignment with the vertical portion of the slot, the spring biasing of the locking shaft upward in combination with the spring biasing of the ejector pins downward, causes the upper end of the punch tip shaft to be pushed downward to release the ball/detent connection between the punch tip shaft and the socket of the locking shaft.

In an embodiment, a lower end of the axial passageway passing through the punch driver accommodates a ring structure. The ring structure, in turn, accommodates and supports the cylinder and prevents upward movement of the cylinder relative to the lower end of the axial passageway when the punch tip shaft is inserted upward through the cylinder to make the ball/detent connection.

In an embodiment, the punch assembly further comprises a punch head that is threadably connected to an upper end of the punch driver. The punch head is substantially disposed within a collar; the punch driver is substantially disposed within a punch guide. The collar includes an outwardly extending upper flange and is further axially disposed within a spring. The spring is trapped between the upper flange of the collar and the punch guide. The collar also includes a plurality of spaced openings disposed below the upper flange. The upper end of the punch head further comprises a plurality of outwardly and radially extending fingers that extend through the openings of the collar to engage an upper end of the spring. Upon depression of the punch head in a downward direction, the fingers engage the spring to compress the spring downward.

In an embodiment, the fingers are an integral part of a ring structure disposed on top of the punch head.

In an embodiment, the ring structure is disposed between an upper end of the punch head and an upper punch cap.

In an embodiment, the punch cap includes a notch for engaging a striker or brake mechanism that prevents rotational movement of the punch cap and punch head upon rotation of the punch driver. In this way, the lower portion of the punch assembly, i.e. the punch driver and punch tip, may be rotated with respect to the punch head to axially lengthen or axially shorten the punch head assembly.

In an embodiment, the axial length of the punch head assembly is adjusted by rotating the punch guide, which results in a rotation of the punch driver and punch tip, while, at the same time, the punch head is held in place.

The present invention also provides an improved punch press apparatus comprising a punch assembly which includes a punch driver accommodated within a punch guide for axial movement within the punch guide. The punch guide prevents rotational movement of the punch driver with respect to the punch guide. The punch assembly further comprises a punch head threadably attached to an upper portion of the punch driver and a punch tip connected to a lower end of the punch driver. Rotation of the punch driver with respect to the punch head results in an axial lengthening or an axial shortening of the punch assembly. The punch head further includes a notch for engaging a lock means which prevents rotational movement of the punch head upon rotation of the punch guide and punch driver. The punch press apparatus further includes a linkage for transmitting rotational movement from a motor to the punch guide and punch driver to thereby lengthen or shorten the punch assembly.

In an embodiment, the punch press apparatus of the present invention further includes a means for sensing the overall length of the punch assembly.

In an embodiment, the means for sensing the overall length of the punch assembly comprises a sensor for detecting a relative vertical position of a target disposed on the punch assembly. The sensor is linked to a controller for activating or deactivating the motor.

In an embodiment, the target sensed by the means for sensing the overall length of the punch assembly is disposed on the punch head.

In an embodiment, the target which is sensed by the means for sensing the overall length of the punch assembly is disposed on the punch tip.

In an embodiment, the means for sensing the overall length of the punch tip assembly comprises a proximity switch and a target.

In an embodiment, the means for sensing the overall length of the punch tip assembly comprises an acoustical transmitter and a receiver, the receiver detecting the presence of the punch assembly between the transmitter and the receiver.

In an embodiment, the means for sensing the overall length of the punch assembly comprises a light transmitter and a receiver, the receiver detecting the presence of the punch assembly between the transmitter and the receiver.

In an embodiment, the punch press apparatus of the present invention further comprises a punch cap mounted onto an upper end of the punch head. The notch for engaging the lock means is disposed on the punch cap.

It is therefore an advantage of the present invention to provide an improved punch assembly with an improved connection between the punch tip and the punch driver to facilitate the removal and installation of the punch tip onto the punch driver.

Another advantage of the present invention is an improved method of measuring the overall length of the punch assembly and adjusting the overall length of the punch assembly.

Another advantage of the present invention is to provide an improved means of engaging the spring with the punch head during the compression of the punch assembly.

Another advantage of the present invention is to provide an improved means of ejecting a punch tip during the removal of the punch tip from the punch driver.

Another advantage of the present invention is to provide an improved means of controlling and adjusting the overall length of a punch head assembly.

Other advantages and objects of the present invention will become apparent upon reading the following detailed description and appended claims, and upon reference to the accompanying drawings.

BRIEF DESCRIPTION OF THE DRAWINGS

For a more complete understanding of the present invention, reference should now be made to the embodiments illustrated in greater detail in the accompanying drawings and described below by way of examples of the present invention.

In the drawings:

FIG. 4 is an elevational sectional view of a punch assembly made in accordance with the present invention;

FIG. 4A is a partial enlarged sectional view of the punch assembly shown in FIG. 4;

FIG. 5 is a top plan view of the punch assembly shown in FIG. 4;

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
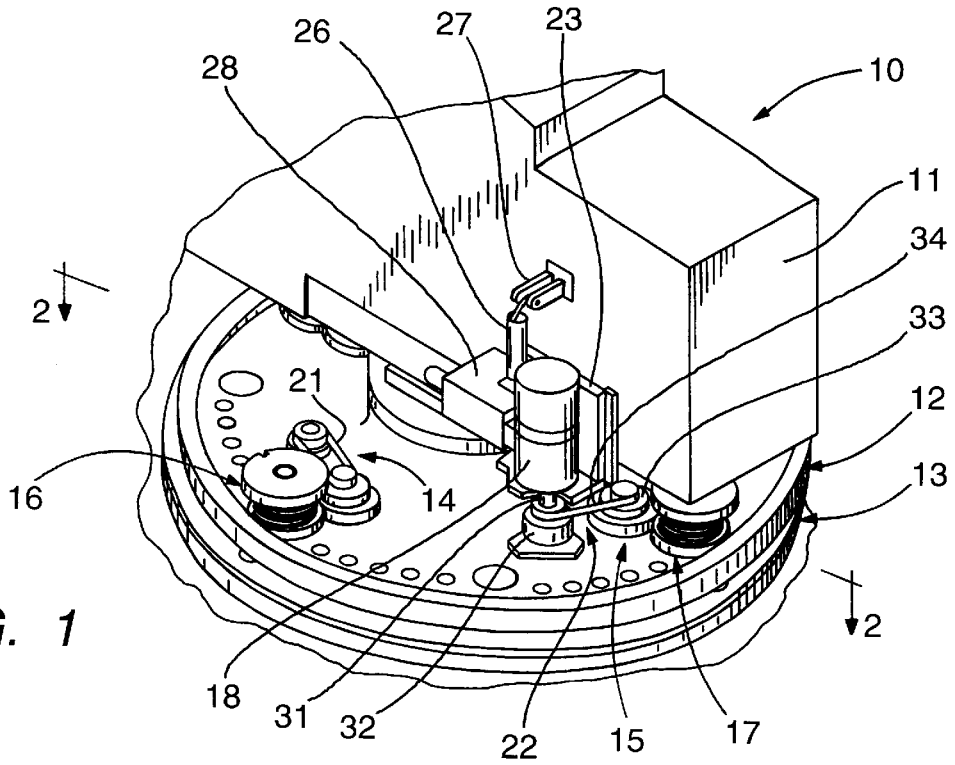
FIG. 1 is a perspective view of an upper turret portion of a punch press made in accordance with the present invention.

Referring to FIG. 1, the punch press of the present invention is generally shown at 10 and includes a punch press housing 11, an upper rotatable turret 12, a lower rotatable turret 13 and at least one indexable tool station, two of which are shown at 14, 15. The tool stations 14, 15 include indexable punch assemblies 16, 17. The drive motor 18 is provided along with linkages 21, 22 to impart rotation to the punch assemblies 16, 17 as discussed below.

Figure 2:
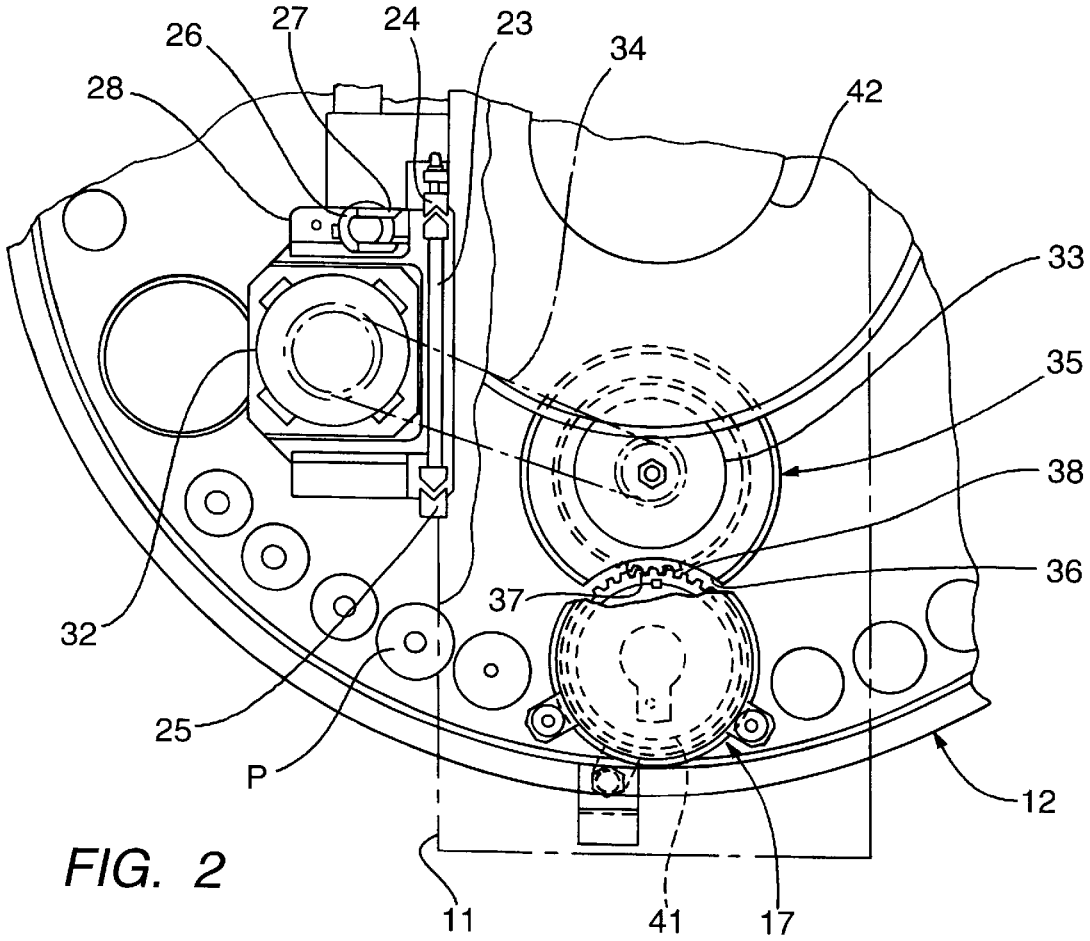
FIG. 2 is a plan view of the punch press shown in FIG. 1, taken generally along lines 2—2.

More specifically, turning to FIG. 2, the turret 12 rotates beneath the housing 11 which supports a slide 23. The slide is mounted between V-shaped rails 24, 25. The actuator 26 connects the bracket 27 to the slide lock 28. The motor 18 is lowered by way of the slide 23 so that its drive shaft 31 (see FIG. 1) engages the drive pulley 32. Rotation of the drive pulley 32 rotates a second pulley 33 by way of the linkage or timing belt 34. Rotation of the second pulley 33 in turn rotates the gear drive 35 which has a shaped opening 36 through which a gear bushing 37 extends to engage the cooperating gear bushing 38 disposed on the outside of the punch guide 41 of the punch assembly 17 which is illustrated in greater detail in FIG. 4. The turret 12 is rotatable about the turret axis 42. Further, as illustrated in FIGS. 1 and 2, the punch assembly 17 is also rotatable through the use of the motor 18. Therefore, not only can the turret 12 be rotated to make use of all of the punching tools P available on the turret 12, indexing stations such as the ones shown at 14 and 15 may also provide rotatable punch assemblies 16, 17 respectively in order to adjust the angular orientation of a punching tool disposed at the indexable station.

Figure 3:
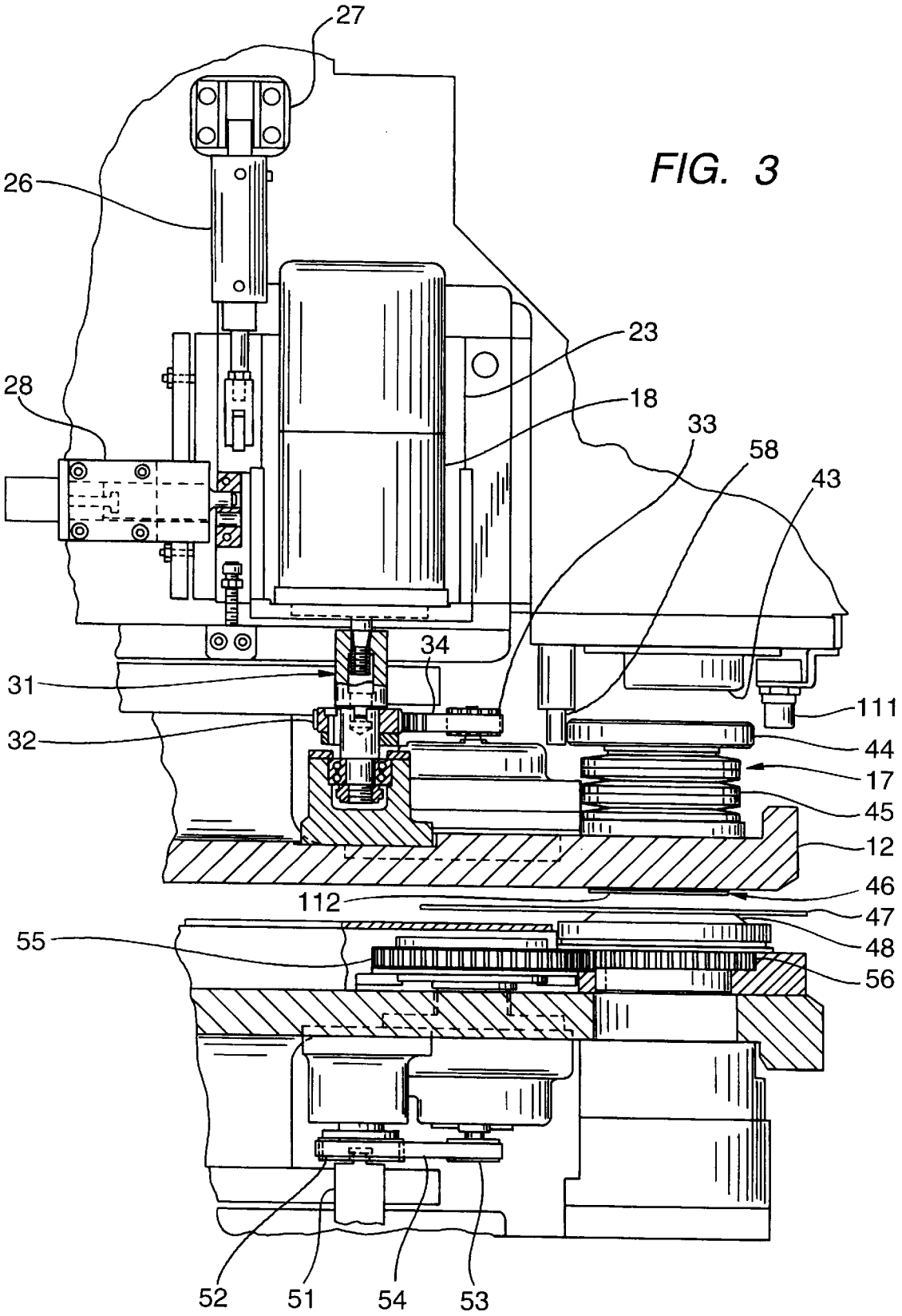
FIG. 3 is an enlarged side elevational view of the punch press shown in FIG. 1, partially cut away.

Referring now to FIG. 3, a ram 43 is disposed above the punch assembly 17. The downward movement of the ram 43 will engage the punch cap 44 which will in turn compress the spring 45 ultimately causing the punch tip 46 to extend downward and engage the workpiece 47. The workpiece 47, as shown in FIG. 3, is resting on top of an indexable die 48 which is rotated using an apparatus similar to the apparatus used to rotate the punch assembly 17. Specifically, a drive shaft 51 extending upward from a motor (not shown) engages a drive pulley 52 which rotates the second pulley 53 by way of the drive belt connection 54. The second pulley 53 is linked to a gear bushing 55 which, in turn, is meshed with the gear bushing 56 that is connected to the indexable die 48.

Similarly, with respect to the punch assembly 17, lowering of the motor 18 on slide 23 by the actuator 26 results in an engagement of the first pulley 32 by the drive shaft assembly 31. Rotation of the drive pulley 32 results in rotation of the second pulley 33 by way of the drive belt 34 as discussed above with respect to FIG. 2.

Turning to FIG. 4, a punch assembly 17 made in accordance with the present invention includes a punch driver 55 that is threadably connected to a punch head 56. The threadable connection between the punch head 56 and the punch driver 55 results in an overall lengthening or shortening of the punch head assembly 17. As shown in FIGS. 3 and 5, the length of the punch assembly 17 may be lengthened or shortened by engaging the notch 57 disposed at an outer periphery of the punch cap 44 with a retractable lock bar 58 which holds the punch cap 44 and consequently the punch head 56 in place while the punch guide 41 and consequently the punch driver 55 and punch tip 46 are rotated by the motor 18.

Returning to FIG. 4, the punch head 56 includes an axial passageway 61 and, similarly, the punch driver 55 includes an axial passageway 62. The axial passageway 62 of the punch driver accommodates a locking shaft 63 which features a lower socket 64 and an upper end 65 designed to accommodate a tool used to twist and push the locking shaft 63 downward to couple the lower socket 64 of the locking shaft 63 with the punch tip shaft 66. Specifically, the upper end 65 of the locking shaft 63 is biased upward by the spring 67. When the socket 64 is disconnected or decoupled from the punch tip shaft 66, the key 68 of the punch driver 55 is disposed at the lower end of the vertical slot 69. In the position shown in FIG. 4, the locking shaft 63 has been pushed downward and twisted so that the key is engaging the horizontal portion 71 of the slot. When the locking shaft 63 has been pushed downward and rotated to assume the position shown in FIG. 4, the socket 64 has been pushed downward over the punch tip shaft 66 and, more specifically, over the upper end 72 of a cylinder 73 (not shown in FIG. 4, see FIG. 6) which causes projecting members preferably in the form of balls 74, 75 to pass through openings in the cylinder 73 like those shown at 76, 77 in FIG. 6 thereby causing the balls to engage the detent 78 disposed at the upper end 79 of the punch tip shaft 66.

Figure 6:
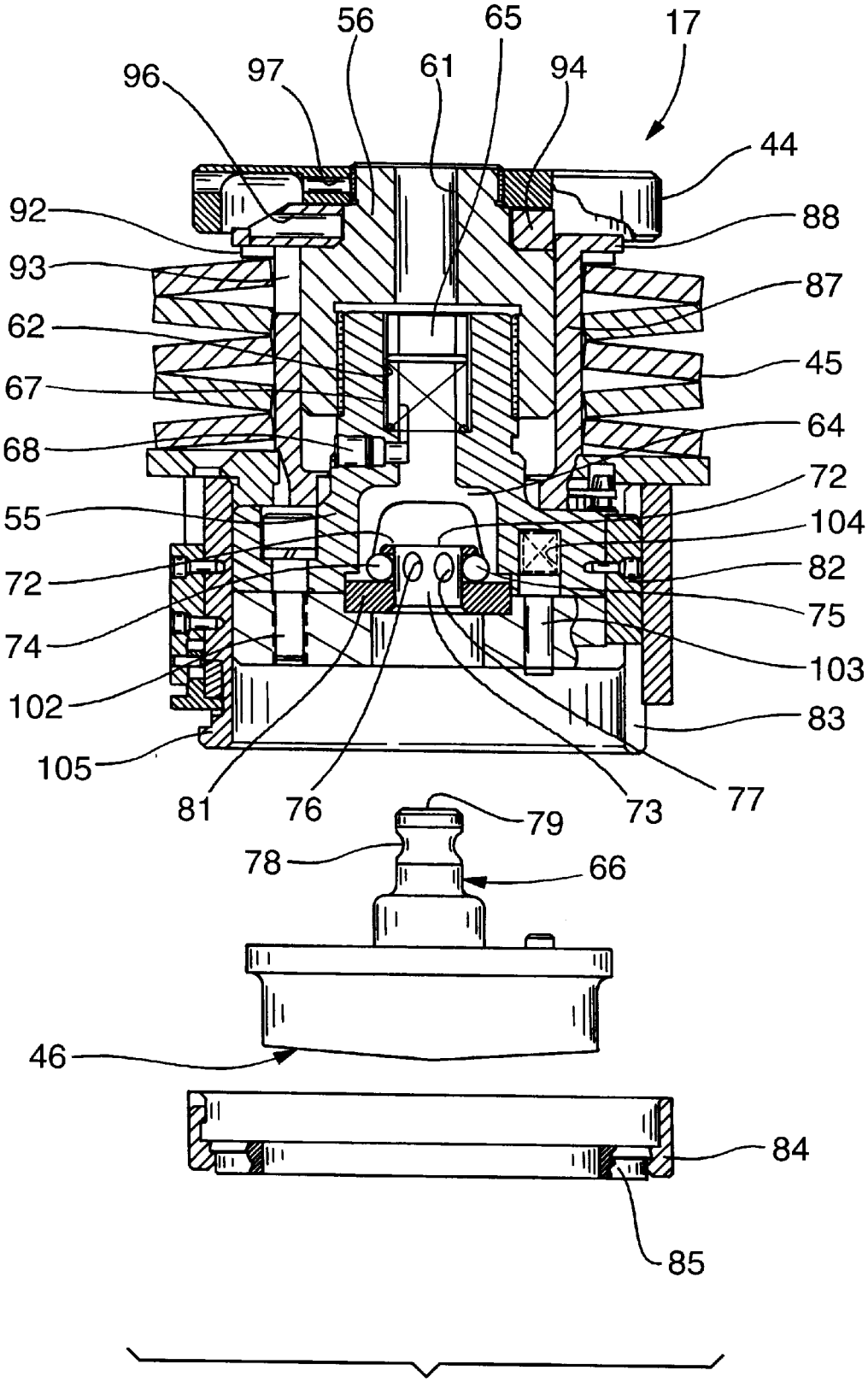
FIG. 6 is a sectional elevational view of an alternative embodiment of a punch assembly made in accordance with the present invention after the punch tip and stripper plate have been detached from the assembly.

Referring to FIG. 6, the cylindrical structure 73 is supported and held in place by the ring structure shown at 81. The ring structure 81 is mounted at the lower end of the passageway 62. The ring structure 81 supports and holds the cylindrical structure 73 in place under any upward pressure imparted by the punch tip shaft 66 and downward pressure imparted by the socket 64.

Still referring to FIGS. 4 and 6 collectively, the punch driver 55 is slidably disposed primarily in the punch guide 41. Rotation of the punch driver 55 within the punch guide 41 is prevented by way of the engagement between the key 82 and the slot 83. The lower end of the punch guide 41 includes a bracket 84 which is detachably connected to a stripper plate 85. The upper end of the punch guide 41 accommodates a shoulder 86 which supports the lower end of the spring 45.

The punch head 56 is accommodated primarily within the collar 87. An upper end of the collar 87 features an outwardly extending flange 88. A washer 92 is disposed between the spring 45 and the flange 88.

Figure 7:
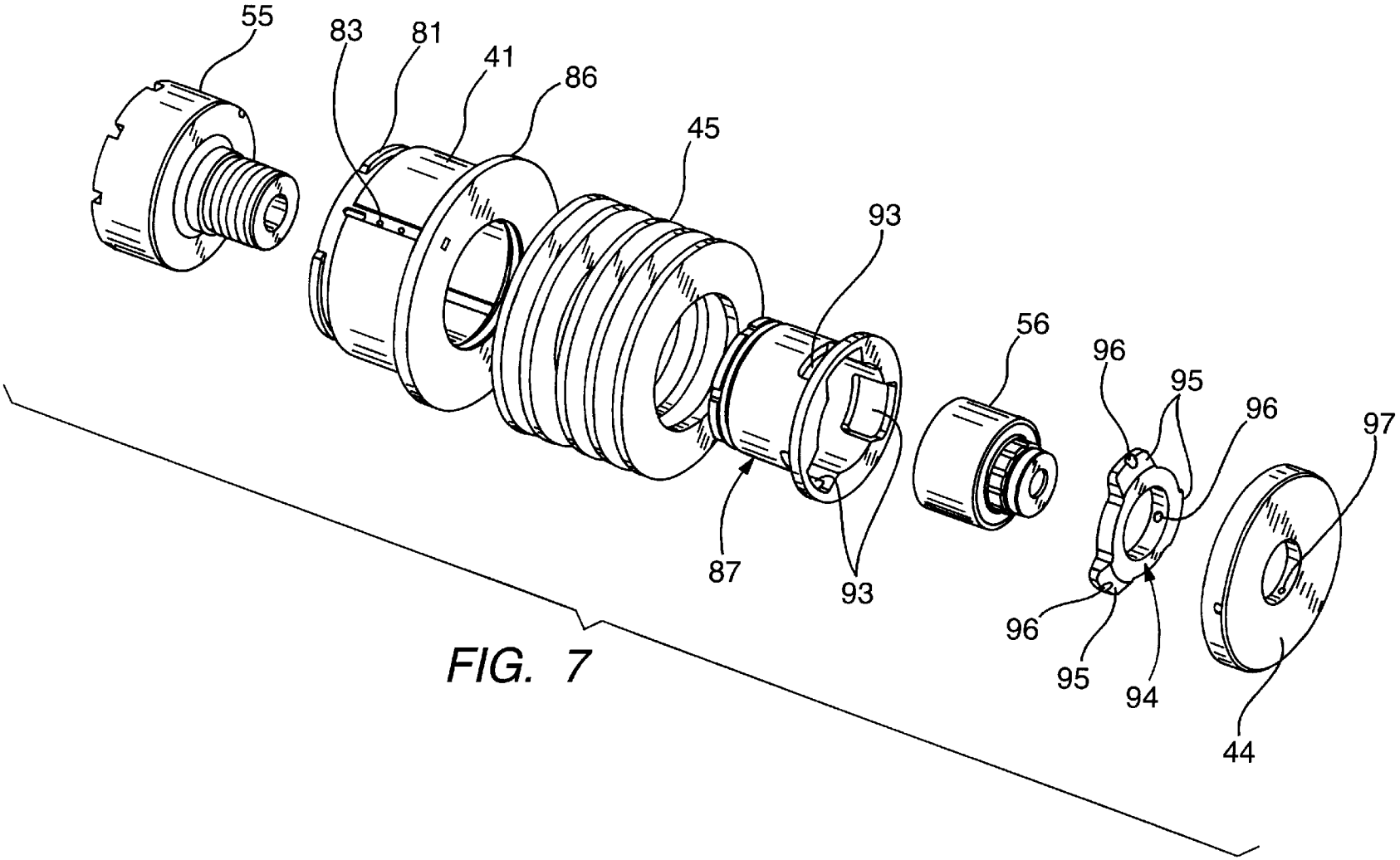
FIG. 7 is an exploded view of the punch head assembly shown in FIG. 6.

As illustrated in FIG. 7, the collar 87 includes a plurality of openings shown generally at 93. Further, the upper end of the punch head 56 is attached to a ring 94 that includes a plurality of outwardly extending fingers 95. The fingers 95 pass through the openings 93 in the collar 87 to engage the spring 45 when the punch head 56 and punch cap 44 are pressed downward by the ram 43 (see FIG. 3). Returning to FIGS. 4 and 6, a threaded opening 96 is provided through the fingers to accommodate set screws for securing the radial position of the ring 94 on the upper end of the punch head 56. Similarly, a threaded opening 97 is provided in the punch cap 44 for securing the punch cap 44 to the punch head 56.

In the embodiments shown in FIGS. 4 and 6, the punch driver 55 is connected to a punch driver end ring 98 by the bolt 102 which threadably connects the driver 55 to the end ring 98. Referring now to FIG. 6, the punch assembly 17 is further equipped with an ejector pin 103 which is spring biased in the downward position by a spring 104. The ejector pin 103 pushes downward on the punch tip 46 to assist in removal of the punch tip 46 from the punch assembly 17.

Thus, in order to remove the punch tip 46 from the punch assembly 17, the bracket 84 and stripper plate 85 are disconnected from the lower tab 105 disposed at a lower end of the punch guide 41. Then, a tool is inserted downward through the axial passageway 61 and 62 to engage the upper end 65 of the locking shaft 63. The shaft is twisted causing the horizontal portion 71 of the slot to pass over the key 68 so that the key 68 is in alignment with the vertical portion 69 of the slot. The bias exerted on the upper end 65 of the locking shaft 63 by the spring 67 forces the locking shaft 63 upward resulting in upward movement of the socket 64. Without the socket 64 forcing the balls 74, 75 into the detent 78 disposed at the end of the punch tip shaft 66, downward pressure exerted on the punch tip 46 by the ejector pin 103 causes disengagement between the balls 74, 75 and the detent 78 thereby releasing the punch tip shaft 66 and punch tip 46.

Further, in order to adjust the overall height of the punch assembly 17, referring to FIG. 3, the motor 18 and drive shaft assembly 31 are lowered so as to engage the drive pulley 32. Rotation of the drive shaft assembly 31 results in rotation of the drive pulley 32 which, in turn, results in rotation of the second pulley 33. As shown in FIG. 2, the second pulley 33 is coupled to the gear bushing 37 which, in turn, is in mesh with the gear bushing 38 that is attached to the exterior of the punch guide 41 (see FIG. 4). Upon activation of the motor 18, the retractable locking bar 58 (see FIG. 3) is extended downward to engage the notch 57 (see FIGS. 4 and 5) so that the punch cap 44 and punch head 56 are not rotated while the punch guide 41 and punch driver 55 are being rotated to adjust the overall axial length of the punch assembly 17.

Figure 9:
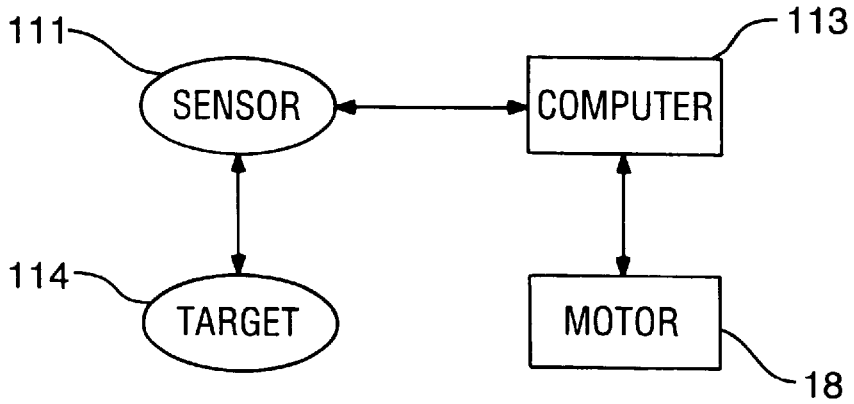
FIG. 9 is a schematic diagram illustrating the linkage between the target, sensor, computer and motor of the punch press assembly of the present invention.

Further, referring again to FIG. 3, a sensor is shown at 111 which may be used to detect the proximity of the punch cap 44 during the length adjustment of the punch assembly 17. Generally, a number of different sensors can work in determining the overall axial length of the punch assembly 17. A sensor 111 may be positioned at or above the punch cap 44 to send a signal to a computer (not shown in FIG. 3, see FIG. 9) to indicate that the punch assembly 17 has reached the pre-selected height or length. A sensor may also be positioned below the turret 12 for purposes of detecting the presence of the lower end 112 of the punch tip 46. Generally speaking, a sensor such as the one shown at 111 may be combined with a target attached or disposed anywhere on the punch assembly 17 to determine the axial length of the punch assembly 17. The sensor 1 1 1 may be a proximity sensor or switch, or the sensor 111 may be in the form of a transmitter, such as a sound transmitter or light transmitter, in combination with a receiver (not shown). During the axial lengthening of the punch assembly 17, the transmission of a signal, either sound or light or other signal, between the transmitter and receiver would be interrupted or interfered with as a portion of the punch assembly 17, such as the punch cap 44 or the punch tip 46 is extended axially in the path between the transmitter and receiver. In addition to a sound or light transmitter/receiver combination, it is anticipated that an electromagnetic transmitter/receiver combination would work as well. The linkage between the motor 18, computer or controller 113, sensor 111 and target 114 is illustrated in FIG. 9.

Figure 8:
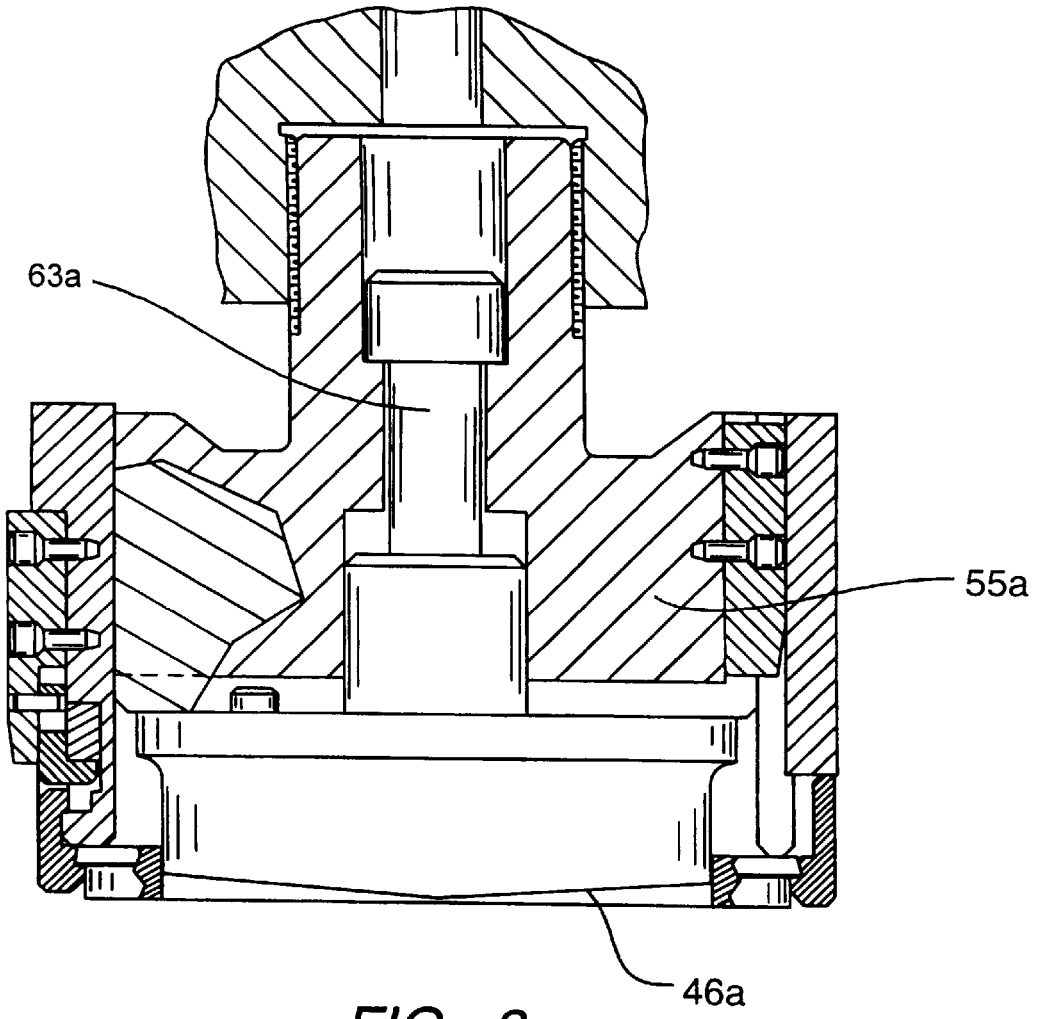
FIG. 8 (PRIOR ART)
FIG. 8 is an elevational sectional view of a prior art punch head assembly.

FIG. 8 is an illustration of a prior art connection between a punch tip **46*a* and a punch driver 55*a*. Specifically, a connecting bolt 63*a* threadably connects the punch driver 55*a* to the punch tip 46*a*. The connecting bolt 63*a* must be tightened to a specific torque rating in order to retain the punch tip 46***a* on the punch driver 55*a*. As shown in FIGS. 4–6, the connection between the punch tip 46 and the punch driver 55 is greatly facilitated by the present invention.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A punch assembly comprising:

a punch driver carried within a punch guide for axial vertical movement within the punch guide, an upper end of the punch driver being threadably connected to a punch head, the punch head being carried within a punch collar, the collar comprising an outwardly extending upper flange, the collar being axially disposed within a spring, the collar further comprising at least one opening disposed adjacent to and below the upper flange, the spring being disposed between the upper flange of the collar and the punch guide, the upper end of the punch head comprising at least one outwardly and radially extending finger that extends through the opening in the collar and provides a stop for an upper end of the spring, the punch driver comprising an axial passageway extending through the punch driver, the axial passageway of the punch driver accommodating a locking shaft, the locking shaft comprising a lower end that is releaseably connected to a punch tip shaft having an upper end and a lower punch tip end, the upper end of the punch tip shaft comprising a detent, the axial passageway comprising a lower end, the lower end of the passageway accommodating a projecting member, the projecting member engaging the detent of the punch tip shaft when the lower end of the locking shaft is pushed downward onto the upper end of the punch tip shaft.

2. The punch assembly of claim 1 wherein the locking shaft is biased upwards by a second spring, the locking shaft further comprising an upper end and a middle section disposed between the upper and lower ends, the middle section comprising a slot comprising a lower portion and an upper portion, the punch driver further comprising a key accommodated in the slot, the projecting member engaging the detent when the locking shaft is pushed downward so that the key is accommodated in the upper portion of the slot.

3. The punch assembly of claim 2 wherein the upper portion of the slot extends horizontally and the lower portion of the slot extends vertically.

4. A punch assembly comprising:

a punch driver carried within a punch guide for axial vertical movement within the punch guide, an upper end of the punch driver being threadably connected to a punch head, the punch head being carried within a punch collar, the collar comprising an outwardly extending upper flange, the collar being axially disposed within a spring, the collar further comprising at least one opening disposed adjacent to and below the upper flange, the spring being disposed between the upper flange of the collar and the punch guide, the upper end of the punch head comprising at least one outwardly and radially extending finger that extends through the opening in the collar and provides a stop for an upper end of the spring, the punch driver comprising an axial passageway extending through the punch driver, the axial passageway of the punch driver accommodating a locking shaft, the locking shaft comprising a downwardly directed tapered socket that detachably receives an upper end of a punch tip shaft that extends upward from a punch tip, the upper end of the punch tip shaft comprising a detent, the axial passageway comprising a lower end, the lower end of the passageway matably receiving a cylinder that detachably receives the punch tip shaft, the cylinder comprising an upper end that extends upward into the tapered socket, the upper end of the cylinder comprising a plurality of spaced holes, each spaced hole being in alignment with a ball trapped between the tapered socket and the cylinder, the balls being forced through the holes of the cylinder and in engagement with the detent of the punch tip shaft when the tapered socket is pushed downward onto the upper end of the punch tip shaft and the upper end of the cylinder.

5. The punch assembly of claim 4 wherein the locking shaft is spring biased upwards by a second spring, the locking shaft further comprises an upper end and a middle section disposed between the upper end and the tapered socket, the middle section comprising a slot comprising a lower portion and an upper portion, the punch driver further comprising a key accommodated in the slot, the balls engaging the detent when the locking shaft is pushed downward so that the key is accommodated in the upper portion of the slot.

6. The punch assembly of claim 5 wherein the upper portion of the slot extends horizontally and the lower portion of the slot extends vertically.

7. A punch assembly comprising:

a punch driver carried within a punch guide for axial vertical movement within the punch guide, an upper end of the punch driver being threadably connected to a punch head, the punch head being carried within a punch collar, the collar comprising an outwardly extending upper flange, the collar being axially disposed within a spring, the collar further comprising a plurality of spaced openings disposed adjacent to and below the upper flange, the spring being disposed between the upper flange of the collar and the punch guide, the upper end of the punch head comprising a plurality of outwardly and radially extending fingers that extend through the openings in the collar and provide a stop for an upper end of the spring, the punch driver comprising an axial passageway extending through the punch driver, the axial passageway of the punch driver accommodating a locking shaft, the locking shaft comprising a downwardly directed tapered socket that detachably receives an upper end of a punch tip shaft that extends upward from the punch tip, the upper end of the punch tip shaft comprising a detent, the axial passageway comprising a lower end, the lower end of the passageway accommodating a cylinder which removably receives the punch tip shaft, the cylinder comprising an upper end that extends upwards into the tapered socket, the upper end of the cylinder comprising a plurality of spaced holes, each spaced hole being in alignment with a ball trapped between the tapered socket and the cylinder, the balls being forced through the holes of the cylinder and in engagement with the detent of the punch tip shaft when the tapered socket is pushed downward onto the upper end of the punch tip shaft and the upper end of the cylinder.

8. The punch assembly of claim 7 wherein the locking shaft is biased upward by a second spring, the locking shaft further comprising an upper end and a middle section disposed between the upper end and the socket, the middle section comprising a slot comprising a lower portion and an upper portion, the punch driver further comprising a key accommodated in the slot, the balls engaging the detent when the locking shaft is pushed downward so that the key is accommodated in the upper portion of the slot.

* * * * *